US010161413B2

(12) United States Patent
Paoletti et al.

(10) Patent No.: US 10,161,413 B2
(45) Date of Patent: Dec. 25, 2018

(54) METHOD FOR PREVENTING CORROSION AND COMPONENT OBTAINED BY MEANS OF SUCH

(71) Applicant: Nuovo Pignone SRL, Florence (IT)

(72) Inventors: Riccardo Paoletti, Florence (IT); Massimo Giannozzi, Florence (IT); Marco Romanelli, Florence (IT); Marco Anselmi, Florence (IT)

(73) Assignee: Nuovo Pignone Srl, Florence (IT)

( * ) Notice: Subject to any disclaimer, the term of this patent is extended or adjusted under 35 U.S.C. 154(b) by 460 days.

(21) Appl. No.: 14/391,708

(22) PCT Filed: Apr. 8, 2013

(86) PCT No.: PCT/EP2013/057287
§ 371 (c)(1),
(2) Date: Oct. 10, 2014

(87) PCT Pub. No.: WO2013/153020
PCT Pub. Date: Oct. 17, 2013

(65) Prior Publication Data

US 2015/0322962 A1 Nov. 12, 2015

(30) Foreign Application Priority Data

Apr. 12, 2012 (IT) ..... CO2012A0015

(51) Int. Cl.
*F04D 29/42* (2006.01)
*C23C 18/16* (2006.01)
(Continued)

(52) U.S. Cl.
CPC ..... *F04D 29/42* (2013.01); *C23C 18/1637* (2013.01); *C23C 18/1653* (2013.01);
(Continued)

(58) Field of Classification Search
CPC ..... F04D 29/02; F04D 29/023; F04D 29/42; F04D 29/4206; F04D 25/0686;
(Continued)

(56) References Cited

U.S. PATENT DOCUMENTS 4,597,448 A 7/1986 Baugh
4,721,436 A * 1/1988 Lepert ..... E21B 43/121 417/391
(Continued)

FOREIGN PATENT DOCUMENTS

CN 2305411 Y 1/1999
CN 1442508 A 9/2003
(Continued)

OTHER PUBLICATIONS

Unofficial English Translation of Chinese Office Action issued in connection with corresponding CN Application No. 201380019338.5 dated Apr. 1, 2016.
(Continued)

*Primary Examiner* — Brad Harcourt
*Assistant Examiner* — David Carroll
(74) *Attorney, Agent, or Firm* — GE Global Patent Operation

(57) ABSTRACT

A method for preventing corrosion in a component of a turbo-machine having a metal substrate made of carbon steel, low alloy steel and stainless steel includes: a first deposition step of depositing a first metallic layer on the substrate by electroplating; a second deposition step of depositing at least a second layer of a nickel alloy on the first layer by electroless plating; at least one thermal treatment step after the deposition steps, said thermal treatment being applied at a temperature and for a time depending on the overall thickness of the layers, the value of said temperature
(Continued)

being directly proportional to the thickness, the value of said time being inversely proportional to the temperature.

9 Claims, 4 Drawing Sheets

(51) Int. Cl.

| | |
|---|---|
| ***C23C 18/50*** | (2006.01) |
| ***E21B 43/12*** | (2006.01) |
| ***F04D 29/02*** | (2006.01) |
| ***C25D 5/12*** | (2006.01) |
| ***F04D 25/06*** | (2006.01) |
| ***C23C 28/02*** | (2006.01) |

(52) U.S. Cl.
CPC ..... *C23C 18/1698* (2013.01); *C23C 18/50* (2013.01); *C23C 28/021* (2013.01); *C25D 5/12* (2013.01); *E21B 43/124* (2013.01); *F04D 25/0686* (2013.01); *F04D 29/02* (2013.01); *F04D 29/023* (2013.01); *F04D 29/4206* (2013.01); *F05D 2230/31* (2013.01); *F05D 2230/90* (2013.01); *F05D 2260/95* (2013.01); *F05D 2300/16* (2013.01); *F05D 2300/171* (2013.01); *F05D 2300/611* (2013.01)

(58) Field of Classification Search
CPC . C23C 18/1637; C23C 18/50; C23C 18/1698; C23C 18/1653; C23C 28/021; F05D 2300/171; F05D 2300/16; F05D 2300/611; F05D 2260/95; F05D 2230/31; F05D 2230/90; E21B 43/124
See application file for complete search history.

(56) References Cited

U.S. PATENT DOCUMENTS

| | | | | |
|---|---|---|---|---|
| 6,146,774 | A | 11/2000 | Okamoto et al. | |
| 2007/0054126 | A1 | 3/2007 | Yasui et al. | |
| 2009/0286104 | A1* | 11/2009 | Tysoe | C23C 18/1651 428/634 |
| 2011/0286855 | A1* | 11/2011 | Cappuccini | B22F 3/15 416/241 R |
| 2012/0055335 | A1* | 3/2012 | Mateman | F04D 13/12 95/153 |
| 2012/0247223 | A1 | 10/2012 | Sawchuk et al. | |
| 2012/0268074 | A1 | 10/2012 | Cooley et al. | |
| 2013/0170922 | A1 | 7/2013 | Persson | |

FOREIGN PATENT DOCUMENTS

| | | | | |
|---|---|---|---|---|
| DE | 102005046799 | A1 | 4/2007 | |
| EP | 2014792 | A1 * | 1/2009 | C23C 18/32 |
| EP | 2058417 | A1 | 5/2009 | |
| EP | 2014792 | A1 | 6/2009 | |
| JP | 58156691 | A | 9/1983 | |
| JP | 6445769 | U | 3/1989 | |
| JP | 03267381 | A | 11/1991 | |
| JP | 0473427 | A | 3/1992 | |
| JP | 04254591 | A | 9/1992 | |
| JP | 05320948 | A | 12/1993 | |
| JP | 071077 | A | 1/1995 | |
| JP | 0893692 | A | 4/1996 | |
| JP | 10317156 | A | 12/1998 | |
| JP | 2006161109 | A | 6/2006 | |
| JP | 2007071031 | A | 3/2007 | |
| JP | 2007108152 | A | 4/2007 | |
| JP | 2008009059 | A | 1/2008 | |
| JP | 2008155581 | A | 7/2008 | |
| JP | 2008214699 | A | 9/2008 | |
| JP | 2013530352 | A | 7/2013 | |
| JP | 2014525219 | A | 9/2014 | |
| WO | 9831849 | A1 | 7/1998 | |
| WO | 9958741 | A1 | 11/1999 | |
| WO | 2005059204 | A2 | 6/2005 | |

OTHER PUBLICATIONS

International Search Report and Written Opinion dated May 30, 2014 which was issued in connection with PCT Patent Application No. PCT/EP13/057287 which was filed on Apr. 8, 2013.

Italian Search Report and Written Opinion dated Dec. 18, 2012 which was issued in connection with the Italian Patent Application No. CO2012A000015 which was filed on Apr. 12, 2012.

Unofficial English Translation of Japanese Office Action issued in connection with corresponding JP Application No. 2015504918 dated Jan. 24, 2017.

Unofficial English Translation of Japanese Search Report Action issued in connection with corresponding JP Application No. 2015504918 dated Feb. 13, 2017.

* cited by examiner

METHOD FOR PREVENTING CORROSION AND COMPONENT OBTAINED BY MEANS OF SUCH

TECHNICAL FIELD

Embodiments of the present invention relate to a method for preventing corrosion in a subsea or onshore or offshore component. The method of embodiments of the present invention can be used for preventing corrosion in a component of a subsea or onshore or offshore turbo-machine.

BACKGROUND ART

Materials like carbon steel, low-alloy steel and stainless steel are normally used when building components which operate in subsea or onshore or offshore environments. If such environments comprise wet carbon dioxide ($CO_2$), carbon steel and low-alloy steel will be affected by corrosion damages. Moreover, if such environments comprise chlorides, stainless steel will be affected by pitting corrosion damages.

It is therefore an object of the present invention to provide an improved manufacturing method for preventing corrosion, which could avoid the above inconveniencies by: efficiently solving the corrosion problem in most of the humid environments containing aggressive contaminants such as chlorides, $CO_2$ and Hydrogen Sulphide ($H_2S$), and at the same time by using less costly materials.

It is a further object of embodiments of the present invention to provide an improved manufacturing method for preventing corrosion on the internal and external surfaces of subsea or onshore or offshore components of complex shape, for example the casing of a motor-compressor.

SUMMARY

The present invention accomplishes such an object by providing a method for preventing corrosion in a component of a turbo-machine having a metal substrate made of carbon steel, low alloy steel or stainless steel, wherein the method includes: a first deposition step of depositing a first metallic layer on said substrate by electroplating; a second deposition step of depositing at least a second layer of a nickel alloy on said first layer by electroless plating; at least one thermal treatment step after said deposition steps, said thermal treatment being applied at a temperature and for a time depending on the overall thickness of said layers, the value of said temperature being directly proportional to said thickness, the value of said time being inversely proportional to said temperature.

According to a further feature of the first embodiment, the method further includes a third deposition step of depositing a third metallic layer on said second layer by electroplating and a fourth deposition step of depositing a fourth layer of said nickel alloy on said third layer by electroless plating.

According to a further feature of the first embodiment, the value of the overall thickness of said layers is between 70 μm and 300 μm.

The solution of the present invention, by providing a multi-layer coating consisting of a nickel-based coating and having the above specified thickness, allows an efficient protection of the core metal substrate. The thermal treatment included in the method allow to achieve a resistant and structurally homogeneous coating having optimum values of ductility (1.000% to 1.025%) and hardness ($HV_{100}$=600 to $HV_{100}$=650).

The electroless nickel plating process provide cost saving by providing an anti-corrosion coating less expensive than stainless steel and more costly alloys (for example nickel-based alloys like Inconel 625, Inconel 718) and by permitting the use of a less expensive material in the core metal substrate, for example carbon or low alloy steel.

The electroless plating process can be easily applied to components of any shape, in particular of complex shape.

The present invention accomplishes the above object also by providing a turbo-machine including a component comprising a metal substrate made of carbon steel, low alloy steel or stainless steel, and a coating including nickel on said substrate, said coating comprising at least a first metallic layer deposited by electroplating and at least a second layer of a nickel alloy deposited by electroless plating, a third metallic layer deposited by electroplating and a fourth layer of a nickel alloy deposited by electroless plating, the thickness of said coating being between 70 μm and 300 μm, said coating having a hardness value between 600 $HV_{100}$ and 650 $HV_{100}$ and a ductility value between 1.000% and 1.025%.

Particularly, albeit not exclusively, the turbomachine of the present invention consists in a motor-compressor comprising a casing having a coating on the internal and/or external surfaces obtained with the method of the present invention.

Further, the present invention accomplishes the above object also by providing a plant for extracting a liquid and/or gaseous hydrocarbon mixture including a wellhead, a pipeline and a turbo-machine as previously described, wherein said pipeline directly connects said turbo-machine to said wellhead. The anti-corrosive properties of the turbo-machine according to the present invention permit to avoid the use of scrubbers and filter systems upstream the turbo-machine, for preventing corrosive substances from reaching the turbo-machine.

BRIEF DESCRIPTION OF THE DRAWINGS

Other object feature and advantages of the present invention will become evident from the following description of the embodiments of the invention taken in conjunction with the following drawings, wherein.

DETAILED DESCRIPTION

With reference to the attached figures, a method for preventing corrosion in a component 1 of a turbo-machine 201 is overall indicated with 100. The component 1 has a metal substrate 5 made of carbon steel, low alloy steel or stainless steel.

Figure 2:
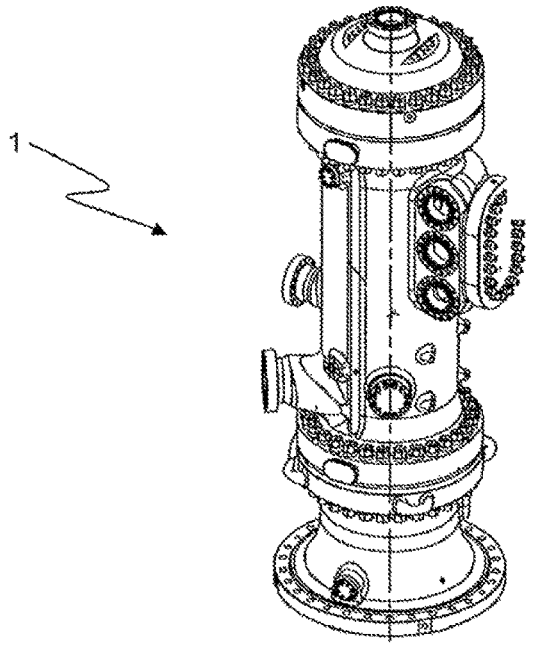
FIG. 2 is an assonometric view of a component of a subsea turbomachine according to the present invention.
Figure 3:
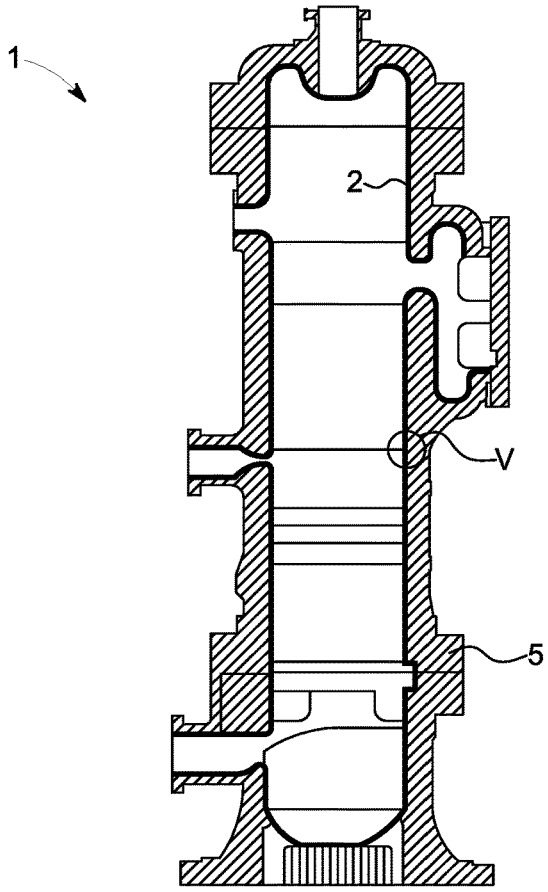
FIG. 3 is a section view of the component of FIG. 2.

In the embodiment in FIGS. 2 and 3, the subsea component 1 is the casing of a subsea compressor.

Figure 4:
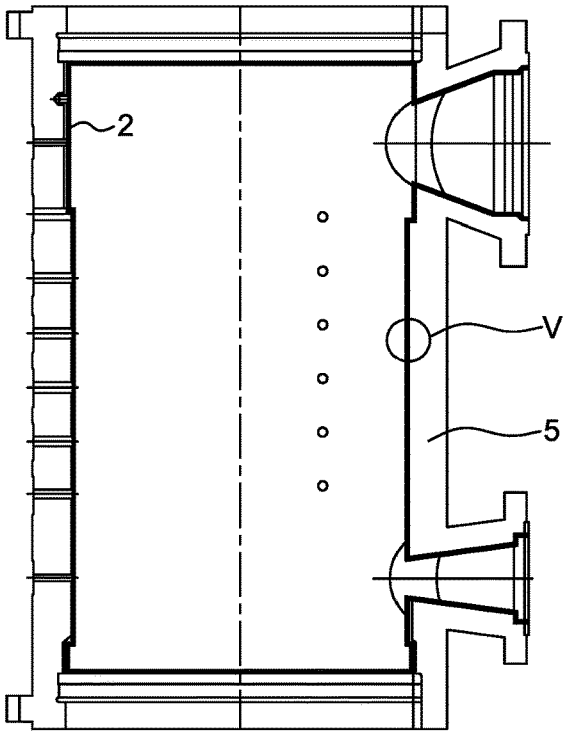
FIG. 4 is a section view of a component of a centrifugal turbo-compressor for onshore or offshore applications, according to the present invention.

According to the embodiments in FIG. 4, the method of the present invention is applied to the casing of a motor-compressor operating onshore or offshore.

Particularly, albeit not exclusively, the method of the present invention can be successfully applied to other components for subsea applications or operating in other type of humid environment, particularly when carbon dioxide ($CO_2$) and/or hydrogen sulphide ($H_2S$) and/or chlorides are present, provided that the method 100 comprises at least a first deposition step 110, a second deposition step 120 and a final thermal treatment step 140, as detailed in the following.

The first deposition step 110 consists in depositing a first layer 2*a* of metallic nickel on the metal substrate 5 by electroplating.

The first layer 2*a* is known in the art as nickel strike and has a thickness comprised between 1 to 10 μm, providing activation for the following second step 120

The second deposition step 120 consists in depositing a second layer 2*b* of a nickel alloy on the first layer 2*a* by electroless nickel plating (also known as ENP).

According to an embodiment of the present invention, the nickel alloy used in the second deposition step 120 of the method 100 consists of a nickel-phosphorous alloy.

According to a more specific embodiment of the present invention, the nickel-phosphorous alloy used in the second deposition step 120 includes 9 to 11% of phosphorous.

According to other embodiments of the present invention, different nickel alloys are used, for example a nickel and boron alloy.

Figure 1A:
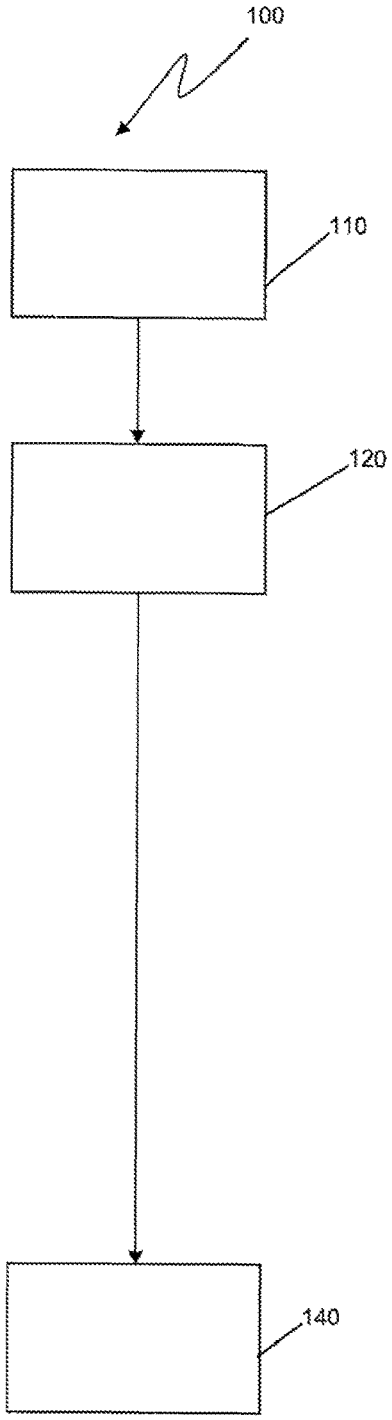
FIGS. 1A and 1B are two block diagrams schematically showing a first embodiment and a second embodiment, respectively, of a method for preventing corrosion according to the present invention.

According to an embodiment of the present invention (FIG. 1A and FIG. 5), the second deposition step 120 includes a first phase of depositing a first portion 20*b* of the second layer 2*b* and a second phase of depositing a second portion 21*b* of the second layer 2*b*. The thickness of the first portion 20*b* of the second layer 2*b* is comprised between 10 to 25 μm.

The thickness of the second portion 21*b* of the second layer 2*b* is equal or greater than the double of the second layer, i.e. equal or greater than 20 μm.

According to another embodiment of the present invention, the method 100 includes further steps of depositing further layers of the nickel alloy by electroless nickel plating, each layer having a thickness greater than the thickness of the previous one.

Figure 1B:
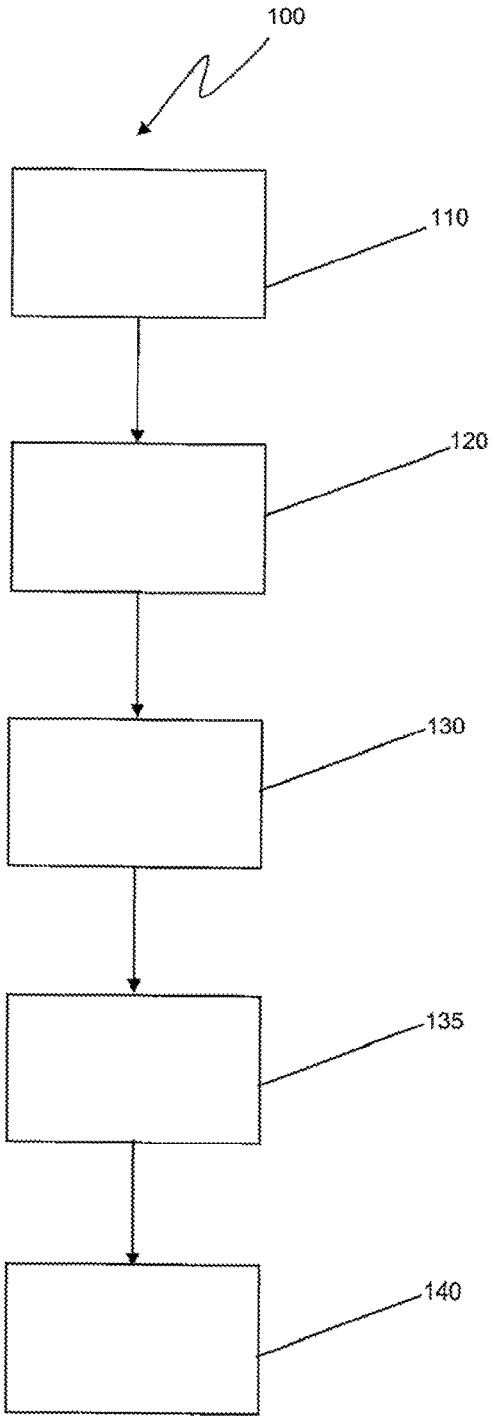

According to another embodiment of the present invention (FIG. 1B and FIG. 6), the method 100, after the second deposition step 120 include a third deposition step 130 of depositing a third nickel layer 2*c* on the second layer 2*b* by electroplating and a fourth deposition step 135 of depositing a fourth layer 2*d* of nickel alloy on the third layer 2*c* by electroless plating. The third layer 2*c* is obtained by impulse electroplating and provides adhesion between the second and fourth ENP layers 2*b*, 2*d*. In addition, the third layer 2*c* avoids formation of pinholes porosity which often occurs in ENP layers having a thickness of more than 100 μm.

According to another embodiment of the present invention (whose results are not shown), the third and fourth deposition steps 130, 135 can be repeated more than one time in order to obtain a multilayer structure wherein each electroless-plating layer is deposited over a respective electroplating nickel layer.

At the end of the electroless nickel plating, a nickel-based coating 2 on the metal substrate 5 is obtained.

As described above, according to different embodiments of the present invention, the coating 2 may include one or more ENP layers.

Figure 5:
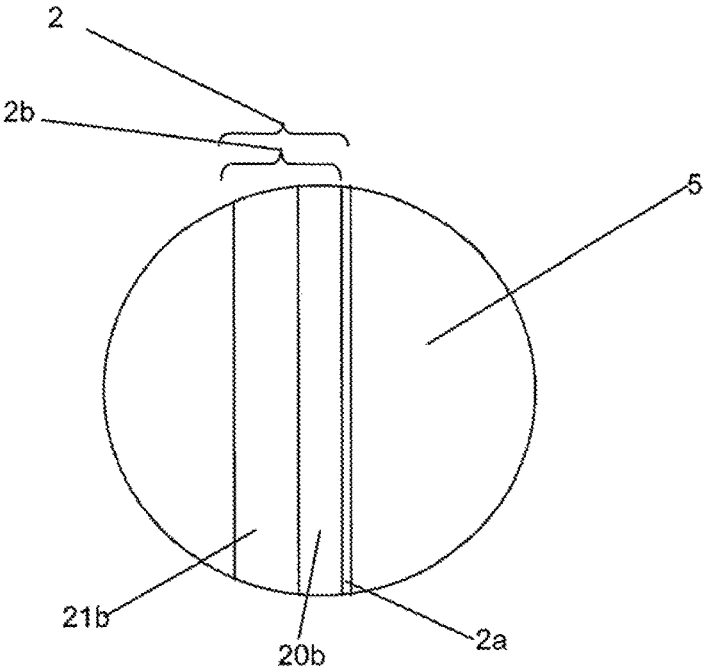
FIG. 5 is an enlarged view of the detail V in FIGS. 3 and 4.

In the embodiment of FIG. 5, the coating 2 consists of the first and second layers 2*a*, 2*b*, the latter comprising a first and a second portion 20*b*, 21*b*, both obtained by electroless nickel plating.

Figure 6:
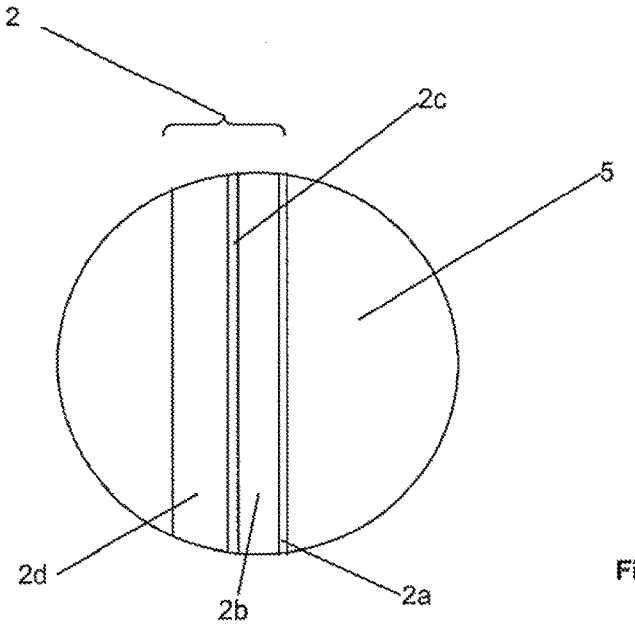
FIG. 6 is an enlarged view of the detail V in FIGS. 3 and 4, corresponding to a different embodiment of the present invention.

In the embodiment of FIG. 6, the coating 2 consists of the first, second, third and fourth layers 2*a*, 2*b*, 2*c*, 2*d*.

In all cases the overall thickness of the coating 2 is between 70 μm and 300 μm.

With reference to FIGS. 2 and 3, the coating 2 is applied to the inner side of the casing of a subsea motor-compressor. With reference to FIG. 4, the coating 2 is applied to the inner side of the casing of a motor-compressor for onshore or offshore applications.

According to other embodiments of the present invention, the coating 2 is applied also on the outer side or on both the inner and the outer sides.

After the deposition steps 110, 120, 130, 135 the method 100 includes a final thermal treatment step 140 applied by exposing the coating 2 to a heating environment, for example in heat treatment oven, at a temperature T and for a time t. The execution of the thermal treatment step 140 allows to get the desorption of the hydrogen incorporated in the coating during the electroplating process. Moreover, through the thermal treatment step 140 the layers of the coating 2, are made more resistant, adherent to each other and structurally homogeneous.

The values of temperature and time data T,t are comprised between 100° C. and 300° C. and between 2 h and 6 h, respectively. The values of temperature and time depend on the overall thickness of the coating 2, the value of said temperature T being directly proportional to the thickness of the nickel coating 2, the value of said time t being inversely proportional to the thickness of the temperature.

In one embodiment of the method 100 the values of temperature T and of time t are dependent on the value of the overall thickness of the nickel coating 2, according to the following table:

| thickness of coating 2 | time of heat treatment | temperature of heat treatment |
|---|---|---|
| 150 μm | 2 hours | 200° C. |
| 120 μm | 3 hours | 190° C. |
| 100 μm | 4 hours | 180° C. |

The above heat treatment allows to reach an hardness value between 600 $HV_{100}$ and 650 $HV_{100}$ and a ductility value between 1.000% and 1.025% in the nickel-based coating 2. The hardness of the coating 2 improves resistance to erosion or abrasion from solid particulate which may flow in the turbo-machine 201, in contact with the coating 2.

The best hardness and ductility results are obtained when the thickness of the coating 2 is between 150 μm and 300 μm.

According to other embodiments of the present invention, more than one final thermal treatment step are applied, provided that the above characteristics are reached in the coating 2.

Figure 7A:
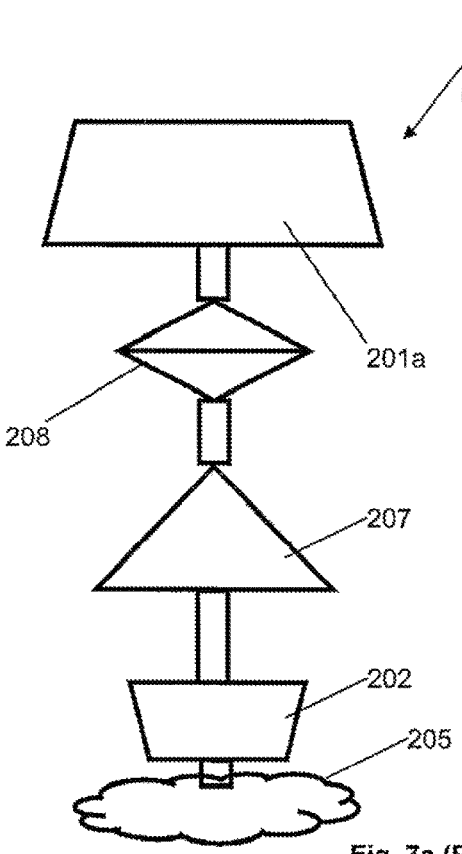
Fig. 7a (PRIOR ART)
FIG. 7A is a schematic view of a known-in-the-art plant for extracting gas from a reservoir.
Figure 7B:
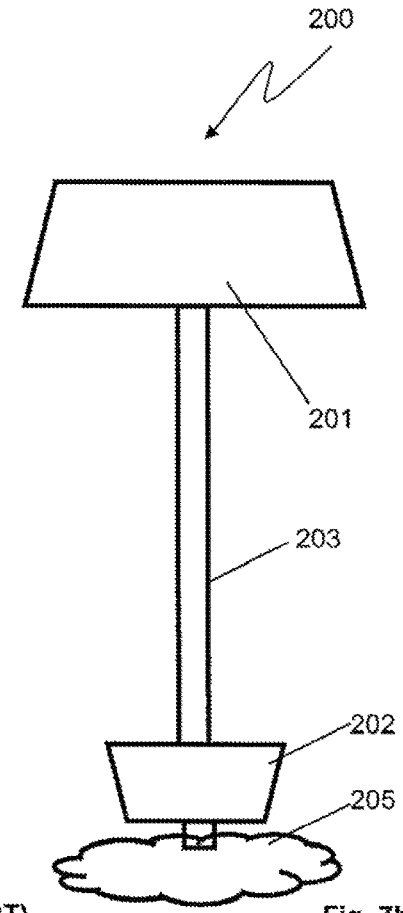
FIG. 7B is a schematic view of a plant for extracting gas from a reservoir, including a component of a turbomachine according to the present invention.

With reference to FIG. 7A a conventional plant 200*a* for extracting a liquid and/or gaseous hydrocarbon mixture from a natural reservoir 205 includes a wellhead 202, a dry or wet scrubber 207 downstream the wellhead 202, a filter 208 downstream the scrubber 207 and a traditional turbo-machine 201*a*, e.g. a traditional centrifugal compressor or a subsea motor-compressor. The scrubber 207 prevents pollutants and in particular corrosive substances, e.g. carbon dioxide ($CO_2$) and/or hydrogen sulphide ($H_2S$) and/or chlorides, to reach the turbo-machine 201*a*. The filter 208 prevents solid particulate to reach the turbo-machine 201*a*. With reference to FIG. 7B, a plant 200 according to the present invention for extracting the same hydrocarbon mixture from the natural reservoir 205 includes a pipeline 203 and the turbo-machine 201. The pipeline 203 directly connects the turbo-machine 201 of the present invention to the wellhead 202. This means that the anti-corrosive properties of the turbo-machine according to the present invention permit to avoid the use of scrubbers and filter systems upstream the turbo-machine.

All the embodiments of the present invention allow to accomplish the object and advantages cited above.

In addition the present invention allows to reach further advantages. In particular, the method above described allows to avoid the presence of through porosity in the coating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements with insubstantial differences from the literal languages of the claims.

What is claimed is:

1. A motor-compressor casing, comprising:

a metal substrate made of carbon steel, low alloy steel, or stainless steel; and a coating comprising nickel on the metal substrate, the coating comprising:

at least a first metallic layer deposited by electroplating; and at least a second layer of a nickel alloy deposited by electroless plating, wherein the second layer of the nickel alloy comprises a first portion of the second layer and a second portion of the second layer, wherein the first portion of the second layer comprises a nickel alloy having substantially the same proportions of constituent metals as the second portion of the second layer, and wherein the thickness of the coating is between 150 μm and 300 μm.

2. A turbomachine comprising a motor-compressor casing according to claim 1.

3. The motor-compressor casing according to claim 1, wherein the first portion of the second layer has a thickness between 10 μm and 25 μm.

4. The motor-compressor casing according to claim 1, wherein the second portion of the second layer has a thickness between 20 μm and 289 μm.

5. The motor-compressor casing according to claim 1, further comprising:

a third metallic layer on the second layer by electroplating; and a fourth layer of the nickel alloy on the third layer by electroless plating.

6. The motor-compressor casing according to claim 1, wherein the layers of the nickel alloy comprise 9% to 11% of phosphorus.

7. The motor-compressor casing according to claim 1, wherein the coating has a hardness value between 600 $HV_{100}$ and 650 $HV_{100}$ and a ductility value between 1.000% and 1.025%.

8. The motor-compressor casing according to claim 1, wherein the second portion of the second layer has a thickness equal to or greater than twice a thickness of the first portion of the second layer.

9. The motor-compressor casing according to claim 1, wherein the second portion of the second layer has a thickness between 20 μm and 100 μm.

* * * * *